United States Patent [19]

Houkes et al.

[11] Patent Number: 4,568,859

[45] Date of Patent: Feb. 4, 1986

[54] DISCHARGE LAMP WITH INTERFERENCE SHIELDING

[75] Inventors: Henk Houkes; Jan W. Denneman; Pieter Postma, all of Eindhoven, Netherlands

[73] Assignee: U.S. Philips Corporation, New York, N.Y.

[21] Appl. No.: 563,498

[22] Filed: Dec. 20, 1983

[30] Foreign Application Priority Data

Dec. 29, 1982 [NL] Netherlands ..... 8205025

[51] Int. Cl.[4] ..... H05B 41/16

[52] U.S. Cl. ..... 315/248; 313/492; 313/493; 315/344

[58] Field of Search ..... 315/248, 344, 85; 313/492, 493

[56] References Cited

U.S. PATENT DOCUMENTS

| | | | |
|---|---|---|---|
| 3,753,036 | 8/1973 | Roche | 313/493 X |
| 4,129,802 | 12/1978 | Vrenken et al. | 313/492 |
| 4,226,167 | 5/1981 | Proud et al. | 315/248 |
| 4,233,653 | 11/1980 | Jongerius et al. | 362/84 |
| 4,254,363 | 3/1981 | Walsh | 315/70 X |
| 4,358,701 | 11/1982 | Roche et al. | 315/493 X |
| 4,360,761 | 11/1982 | Roche | 315/492 X |
| 4,427,921 | 1/1984 | Proud et al. | 315/248 |
| 4,427,924 | 1/1984 | Proud et al. | 315/248 |
| 4,492,898 | 1/1985 | Lapatovich et al. | 315/248 |

FOREIGN PATENT DOCUMENTS

| | | | |
|---|---|---|---|
| 53-4382 | 1/1978 | Japan | 313/493 |

*Primary Examiner*—Robert Lindsay
*Attorney, Agent, or Firm*—Robert S. Smith

[57] ABSTRACT

A discharge lamp having a sealed glass vessel filled with gas and a metal vapor, operated with a supply at a frequency of at least 20 kHz. An interference-suppressing conductive layer is arranged on a wall surface surrounding the discharge, and connected to an electric supply lead-in wire. Preferably, a plurality of insulated metal rings, on the outside of the wall, also surround the discharge.

7 Claims, 1 Drawing Figure

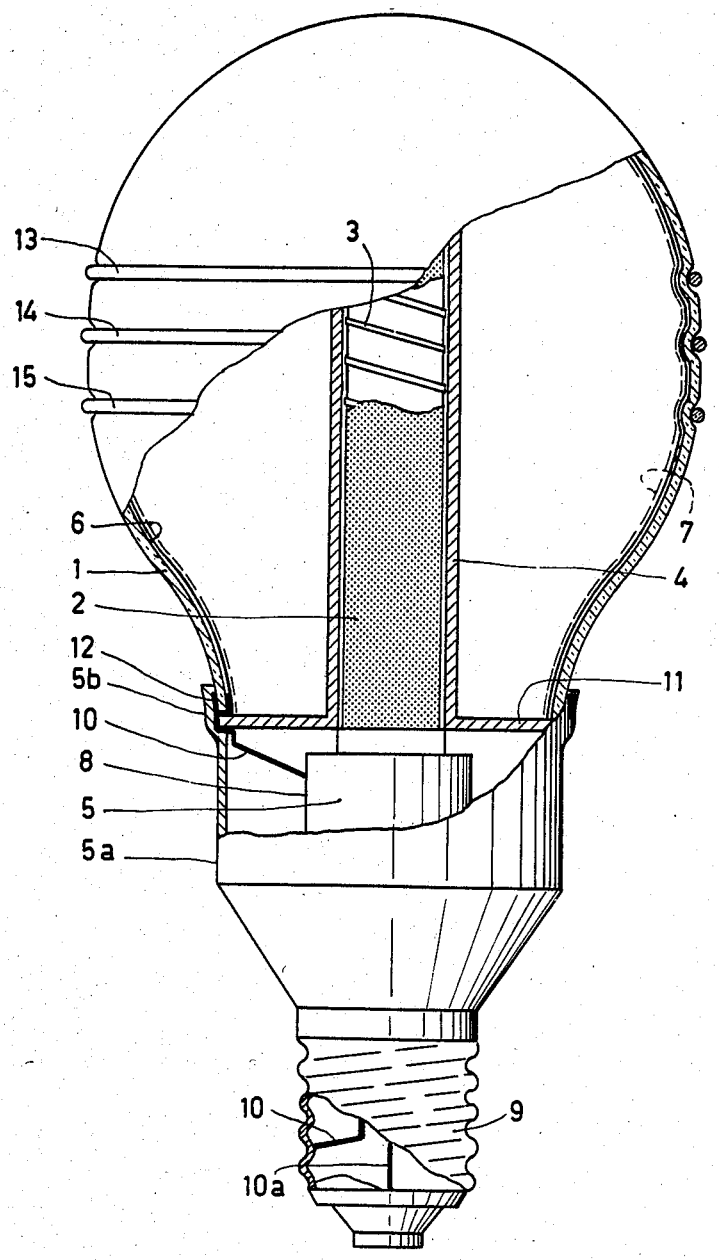
13
14
15
3
6
1
2
12
5b
10
8
5
5a
7
4
11
10
9
10a

DISCHARGE LAMP WITH INTERFERENCE SHIELDING

BACKGROUND OF THE INVENTION

The invention relates to a gas and/or vapor discharge lamp having a glass lamp vessel which is sealed in a vacuum-tight manner and which is filled with a metal vapor and a rare gas, and more particularly to such a lamp which is intended to be operated with a high-frequency supply voltage (hereinafter referred to as a "discharge lamp"). An electric discharge is produced in the lamp envelope, and a transparent conductive layer is placed around a wall surface to surround the discharge.

The expression "a lamp operated at high frequency" is to be understood herein to mean a lamp which is operated with a supply voltage at a frequency of more than approximately 20 kHz.

A discharge lamp of the aforementioned kind is, for example, a low-pressure mercury vapor discharge lamp having a lamp vessel provided with electrodes which are connected to an electronic circuit for high-frequency operation, a low- or high-pressure sodium vapor discharge lamp operated at high frequency, or a so-called electrodeless discharge lamp, in which a high-frequency electromagnetic field is induced in the lamp vessel by means of, for example, a core of magnetic material, such as ferrite.

A problem occurring during the operation of the aforementioned discharge lamps, especially with electrodeless gas discharge lamps, is that electromagnetic fields are produced outside the lamp envelope in the vicinity of the lamp, which cause high-frequency interference currents in the supply mains; international standards, such as VDE, CISPR and FCC standards, apply both to the strength of the electromagnetic fields outside the lamp and to the value of the interference currents. These standards indicate a limit for the maximum value of the interference.

From the published Japanese Patent Application No. 51-78660, an electrodeless low-pressure mercury vapor discharge lamp operated at high frequency is known which has a lamp vessel the inner wall surface of which is provided with an interference-suppressing transparent conductive layer, which is connected to a wire-shaped lead-through member in the wall of the lamp envelope, this lead-through member being connected to earth in the operative condition of the lamp. This Patent Application describes that the strength of the electromagnetic fields outside the lamp envelope is reduced. However, it has been found that in these lamps, in which the conductive layer is connected to earth, disturbing electric interference currents were obtained in the supply mains. This is disadvantageous because the aforementioned standards cannot then be satisfied.

SUMMARY OF THE INVENTION

The invention has for its object to provide a discharge lamp which is suitable for operation with a high-frequency supply voltage, and satisfies the aforementioned standards with respect to electric interference currents in the supply mains.

According to the invention, a discharge lamp of the kind mentioned in the opening paragraph is therefore characterized in that the transparent conductive layer is connected in the operative condition of the lamp to one of the lead-in wires of the supply mains.

In a lamp according to the invention, during its operation the high-frequency electric interference in the supply mains is reduced to a value which lies well below the standard applying thereto. The invention is based on the idea that the electrical component of the electromagnetic field can be considered as a high-frequency voltage source having a given internal resistance, which in the operative condition is connected at one end to the supply mains. The internal conductive layer then constitutes an impedance which shunts this voltage source. Since this impedance has a low resistance value with respect to the parasitic impedance of the source to earth, the current is reduced through this parasitic impedance. As a result in that the interference current, which then flows through the parasitic impedance and the conductors of the supply mains, remains below the maximum standard level. In lamps, in which the lamp vessel and the supply unit are an integral part, such as, for example, in electrodeless lamps, a low-resistance conductive body (such as a housing of sheet metal) is also present around the supply unit, and this housing is connected to one of the mains conductors during operation. In this case, undesired interference currents through earth are also avoided.

In a particular embodiment of the lamp according to the invention, the conductive transparent layer consists of tin-doped indium oxide. Such a layer can be applied in a comparatively simple manner to the inner wall surface of a lamp envelope, for example, by spraying a solution containing indium chloride and a small quantity of tin chloride in butyl acetate.

As has been stated already, the invention can be applied in various lamp types. In a fluorescent low-pressure mercury vapor discharge lamp according to the invention, the conductive layer is present between the glass wall and the luminescent layer. In low- and high-pressure sodium vapor discharge lamps, which are provided with an outer envelope surrounding the discharge tube, the conductive transparent layer is preferably present on the inner wall surface of the outer envelope.

Very favorable results were obtained with an electrodeless discharge lamp which is suitable to be operated in the operaive condition at a frequency of more than 1 MHz, the sheet resistance of the transparent conductive layer being at most 100Ω. In an embodiment of this lamp, the lamp vessel accommodates a core of magnetic material, in which the high-frequency magnetic field can be induced by means of an electric supply unit. In this case, an electromagnetic field is produced in the lamp vessel. The lamp vessel contains a small quantity of mercury vapor and a rare gas. The inner wall surface of the lamp vessel comprises, besides the transparent conductive layer, a luminescent layer which is provided on this layer and which converts the ultraviolet radiation produced in the lamp envelope into visible light. The magnetic core consists of ferrite and is rod-shaped (see, for example, U.S. Pat. No. 3,521,120).

In a particular embodiment of the lamp described above, a number (for example three to five) of metal rings are arranged to completely surround the discharge. In this case, interference currents, which are induced at the conductors of the supply mains due to the presence of a magnetic field, are strongly reduced. In a preferred embodiment, the metal rings are constructed as layers having a width of a few mms and a thickness of, for example, 100 μm, which are applied to the outer wall surface of the lamp vessel, for example, by spraying. Preferably, the rings are constructed as metal wires which are located in grooves provided in the outer wall surface of the lamp envelope. It has been found that the screening of the magnetic field is then sufficiently effective.

An embodiment of the lamp according to the invention will be described more fully with reference to the drawing.

BRIEF DESCRIPTION OF THE DRAWING

The drawing shows diagrammatically, partly in elevation and partly in longitudinal sectional view, an embodiment of an electrodeless low-pressure mercury vapour discharge lamp according to the invention.

DESCRIPTION OF THE PREFERRED EMBODIMENT

The lamp is provided with a glass lamp vessel 1 which is filled with a quantity of mercury and a rare gas, such as argon. The lamp is further provided with a rod-shaped core 2 of magnetic material (ferrite) which is located in an induction coil 3. The core 2 and the coil 3 are located in a reentrant part 4 of the lamp vessel 1 lying near the longitudinal axis of the lamp. The coil 3 comprises a plurality of turns of copper wire (for example seven), a small number of which are shown in the drawing. The coil 3 is connected to an electric supply unit 5 (shown diagrammatically) by means of which a high-frequency electromagnetic field can be induced in the lamp vessel 1. This field is surrounded by the wall of the lamp vessel, on the inner wall of which is present a transparent conductive layer 6. This layer 6 is covered by a luminescent layer 7 which converts the ultraviolet radiation produced in the lamp vessel into visible light (this layer is indicated by a broken line in the drawing). The transparent layer 6 is connected through a metal housing 8 arranged to surround the supply 5 (which is located in the lamp base 5*a*, which consists of synthetic material) to the wall of the cap 9, by means of which the lamp can be screwed into a holder. The connection wire is designated by reference numeral 10. During operation of the lamp,the conductive layer 6 and the metal housing 8 are then connected to one of the lead-in wires of the mains. The supply 5 is connected during operation of the lamp directly to the mains through the wire 10*a*.

The conductive layer 6 is transparent, that is to say that the light produced by the luminescent layer 7 is passed substantially completely by the layer. The conductive layer 6 is passed through the wall of the lamp vessel 1 at the area at which this wall is secured in a vacuum-tight manner to a glass bottom plate 11. This connection is established by means of a suitable connection material, such as glass enamel. In this case, at an area on the edge of the wall of the lamp envelope an electrically conducting metal body 12 bent in the shape of a U is secured, which is electrically connected on the one hand to the layer 6 and on the other hand to the wire 10. The base 5*a* has such a high upright edge 5*b* that the lamp can be handled safely. The layer 6 consists of tin-doped indium oxide having a sheet resistance of at most 100Ω. The conductive layer 6 can be considered as a low-ohmic impedance which is electrically connected parallel across the high-frequency voltage source. Especially at operating frequencies of more than 1 MHz and a resistance value of less than 100Ω, the current through the parasitic impedance (and hence the interference current through the mains conductors) is prevented from having such a value that the applied standards are exceeded.

In the embodiment shown in the drawing, there are provided around the lamp vessel 1 at the height of the induction coil 3 three copper rings 13, 14 and 15, which surround the discharge and are located in grooves provided especially for this purpose in the outer wall of the lamp envelope. Due to the presence of the rings, the lamp is prevented from acting as a magnetic interference source, as a result of which interference currents are induced in the supply mains.

In a practical embodiment of a lamp of the kind described above, the max. outer diameter of the glass lamp vessel is approximately 6.5 cm, while its length is 7.0 cm. The lamp vessel contains approximately 6 mg of mercury and a quantity of argon at a pressure of approximately 70 Pascal. The luminescent layer consists of a mixture of two phosphors, for example green luminescing terbium-activated cerium magnesium aluminate and red luminescing yttrium oxide activated by a trivalent europium.

The magnetic material of the rod-shaped core consists of a ferrite having a relative permeability of approximately 200. An induction coil consisting of copper wire having a diameter of 0.5 mm is arranged to surround this ferrite core. The inductance of the coil is approximately 4.5 μH. The inner conductive ayer is applied to the inner wall surface of the lamp vessel by spraying a solution containing indium chloride and a small quantity of tin chloride in butyl acetate. The sheet resistance is approximately 20Ω. The conductive layer is applied before the luminescent material is provided. The thickness of the conductive layer is approximately 0.5 μm.

The electric supply unit is screened by a housing of sheet metal. This supply unit accommodates a high-frequency oscillator having a frequency of 2.65 MHz. The copper wires 13, 14 and 15 have a thickness of approximately 0.5 mm.

With a power of 15 W supplied to the lamp, the luminous flux is approximately 900 lumen. The luminous efficacy of the lamp is 60 lumen/W.

What is claimed is:

1. A discharge lamp comprising:

a glass lamp vessel having a wall, and sealed in a vacuum-tight manner, a metal vapor and a rare gas contained within said vessel, said vessel and said vapor and gas being arranged and selected such that said lamp is operable with a high-frequency supply voltage to produce an electric discharge within the vessel, at least one lead-in wire for connection to electric supply means, and an interference-suppressing transparent conductive layer disposed on a surface of the wall of said vessel, arranged to surround the discharge, characterized in that said interference-suppressing layer has a sheet resistance of at most approximately 100 ohms, and is connected to one of said lead-in wires.

2. A lamp is claimed in claim 1, characterized in that the interference-suppressing layer consists of tin-doped indium oxide.

3. An electrodeless lamp as claimed in claim 2, characterized in that the glass vessel and filling are selected for operation at a frequency of more than 1 MHz, and that the sheet resistance of the interference-suppressing layer is at most 100 ohms.

4. An electrodeless lamp as claimed in claim 1, characterized in that the glass vessel and filling are selected for operation at a frequency of more than 1 MHz, and that the sheet resistance of the interference-suppressing layer is at most 100 ohms.

5. A discharge lamp comprising:

a glass lamp vessel havng a wall, and sealed in a vacuum-tight manner, a metal vapor and a rare gas contained within said vessel, said vessel and said vapor and gas being arranged and selected such that said lamp is operable with a high-frequency supply voltage to produce an electric discharge within the vessel, at least one lead-in wire for connection to electric supply means, and an interference-suppressing transparent conductive layer disposed on a surface of the wall of said vessel, arranged to surround the discharge, characterized in that said interference-suppressing layer has a sheet resistance of at most 100 ohms, and is connected to one of said lead-in wires, and the lamp includes a plurality of metal rings, insulated from each other and from said lead-in wires, arranged on the outside of said lamp vessel wall so as to surround the discharge.

6. A lamp as claimed in claim 5, characterized in that said plurality of rings consists of three copper wires.

7. A lamp as claimed in claim 5, characterized in that said plurality of metal rings consists of at least three and a maximum of five metal rings.

* * * * *